US007909499B2

(12) United States Patent
Snagel et al.

(10) Patent No.: US 7,909,499 B2
(45) Date of Patent: Mar. 22, 2011

(54) LED TRACK LIGHTING MODULE

(75) Inventors: Paul Snagel, Chicago, IL (US); Matthew Wnek, Elk Grove Village, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 394 days.

(21) Appl. No.: 12/080,225

(22) Filed: Apr. 1, 2008

(65) Prior Publication Data

US 2009/0244925 A1 Oct. 1, 2009

(51) Int. Cl.
*H01R 33/00* (2006.01)

(52) U.S. Cl. ..... 362/648; 362/221

(58) Field of Classification Search ..... 362/648, 362/221, 391; 439/121
See application file for complete search history.

(56) References Cited

U.S. PATENT DOCUMENTS 5,334,037 A * 8/1994 Gabrius et al. ..... 439/118
D362,656 S 9/1995 Roos et al.
6,059,582 A * 5/2000 Tsai ..... 439/121
6,802,626 B2 10/2004 Belfer et al.
7,221,104 B2 5/2007 Lys et al.
7,306,359 B2 12/2007 Harwood
7,364,346 B2 * 4/2008 Uhler et al. ..... 362/648
2003/0011538 A1 * 1/2003 Lys et al. ..... 345/39
2005/0169015 A1 * 8/2005 Luk et al. ..... 362/648
2009/0086492 A1 * 4/2009 Meyer ..... 362/294

* cited by examiner

*Primary Examiner* — Evan Dzierzynski

(57) ABSTRACT

A track light module for use with a low-voltage track carrying a pair of elongated conductors transversely spaced from each other and accessible through a longitudinal slot in the track. The module includes a first housing that contains a printed circuit board carrying an LED and forming an aperture permitting light from the LED to be radiated beyond the first housing. A second housing carries a pair of electrical conductors adapted to extend into the low-voltage track to make contact with the conductors within the track. The second housing also includes surfaces for fastening the second housing to the track when the second housing and the track are moved relative to each other. A pair of electrical contacts on the printed circuit board contact the conductors carried by the second housing and thereby receive electrical power for the LED. A connector attaches the first and second housings together.

17 Claims, 5 Drawing Sheets

LED TRACK LIGHTING MODULE

FIELD OF THE INVENTION

The present invention relates generally to track lighting and, more particularly, to a track lighting module containing a light-emitting diode ("LED") for use with a low-voltage track as a power supply.

BACKGROUND OF THE INVENTION

As LED lighting becomes more prevalent, there is an increasing need for track lighting systems that can be efficiently manufactured at a low cost, and also can be easily and quickly installed in a manner that provides reliable operation over years of operation.

SUMMARY OF THE INVENTION

One embodiment provides a track light module for use with a low-voltage track carrying a pair of elongated conductors transversely spaced from each other and accessible through a longitudinal slot in the track. The module comprises a first housing containing a printed circuit board that carries an LED and forming an aperture permitting light from the LED to be radiated beyond the first housing. A second housing carries a pair of electrical conductors adapted to extend into the low-voltage track to make contact with the conductors within the track. The second housing also includes surfaces for fastening the second housing to the track when the second housing and the track are moved relative to each other. A pair of electrical contacts on the printed circuit board contact the conductors carried by the second housing and thereby receive electrical power for the LED. A connector attaches the first and second housings together.

When installed on a track, the resulting track lighting assembly comprises a low-voltage track carrying a pair of elongated conductors transversely spaced from each other and accessible through a longitudinal slot in the track, and a light module including a first housing that contains a printed circuit board carrying an LED and forms an aperture permitting light from the LED to be radiated beyond the second housing. A second housing carries a pair of electrical conductors adapted to extend into the low-voltage track to make contact with the conductors within the track. The second housing also includes surfaces for fastening the second housing to the track when the second housing and the track are moved relative to each other. A pair of electrical contacts on the printed circuit board contact the conductors carried by the second housing and thereby receive electrical power for the LED. A connector attaches the first and second housings.

This invention permits the light module to be quickly and easily assembled from a small number of parts that simply snap together so that no separate fastening devices are required. Thus, the light module can be efficiently manufactured in large numbers at a low cost. The final assembly has good structural integrity which is maintained over a long operating life.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
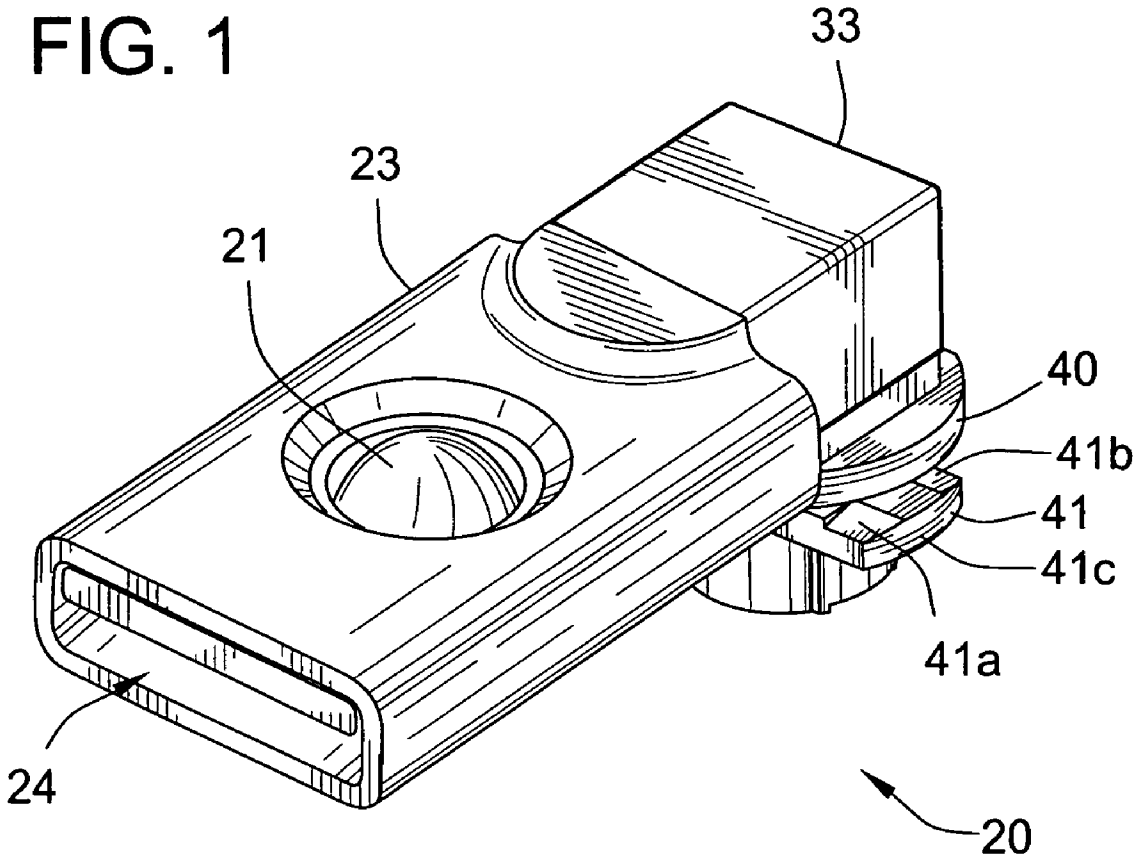
FIG. 1 is a top perspective view of a track light module adapted to be mounted on track carrying power conductors.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Turning now to the drawings, a conventional low-voltage track 10 (FIGS. 2 and 5) includes a pair of elongated conductors 11 and 12 connected to a transformer that converts 120-volt AC power to a suitable low-voltage power to be distributed by the track 10, such as 12-volt AC power. The track housing 13 is a plastic extrusion having a generally rectangular transverse cross-section forming a hollow interior 14 that is open at both ends and through a longitudinal slot 15 in the top wall of the housing 13. The conductors 11 and 12 extend along the length of the track 10 and are held in place by a pair of curved flanges 16 and 17 that terminate above the bottom wall 18 of the track 10, to allow access to the conductors at any point along the length of the track 10. This permits light modules to be connected to the conductors 11 and 12 at any desired location along the track 10.

FIGS. 1-8 depict a light module 20 adapted to be mounted on the track 10 so that power from the conductors 11 and 12 illuminates a light-emitting diode (LED) (or LED cluster) mounted beneath a translucent lens 21 on a small printed circuit board (PCB) 22. As used herein, the term "LED" includes a cluster of light-emitting diodes. The PCB 22 is surrounded by a first housing formed by a sleeve 23 that has an open end 24 for receiving the PCB 22, and a top aperture 25 through which the lens 21 protrudes when the PCB 22 is in place inside the sleeve 23. The lens 21 is preferably coated on its inside surface with a phosphor to help achieve a desired color temperature of light (e.g., 3000K or 5000K) and diffuse the light emitted for more even distribution.

Figure 2:
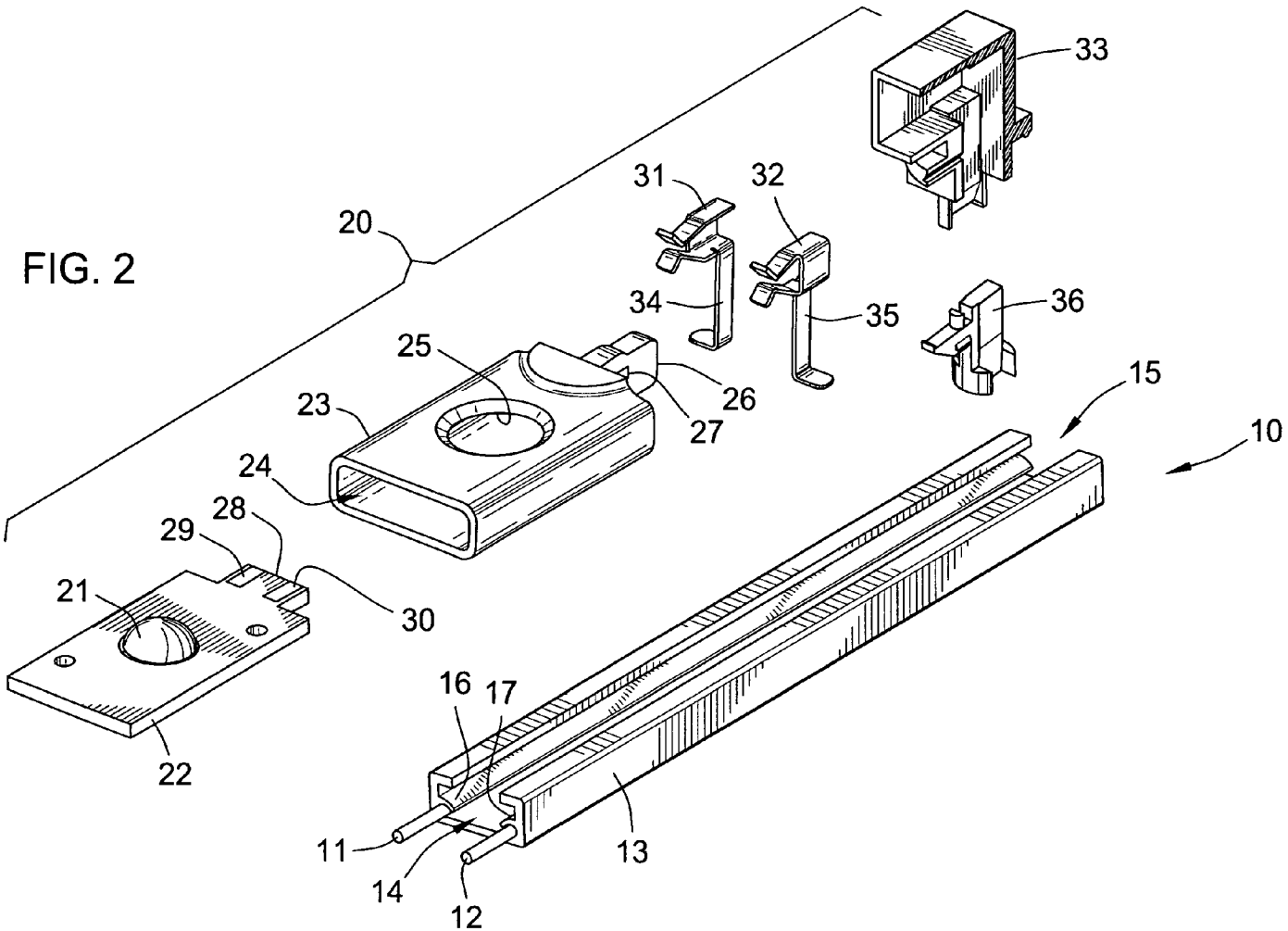
FIG. 2 is an exploded top perspective view of the light module shown in FIG. 1 and a track on which the light module can be mounted, with the second housing of the light module sectioned to show the internal structure.
Figure 3:
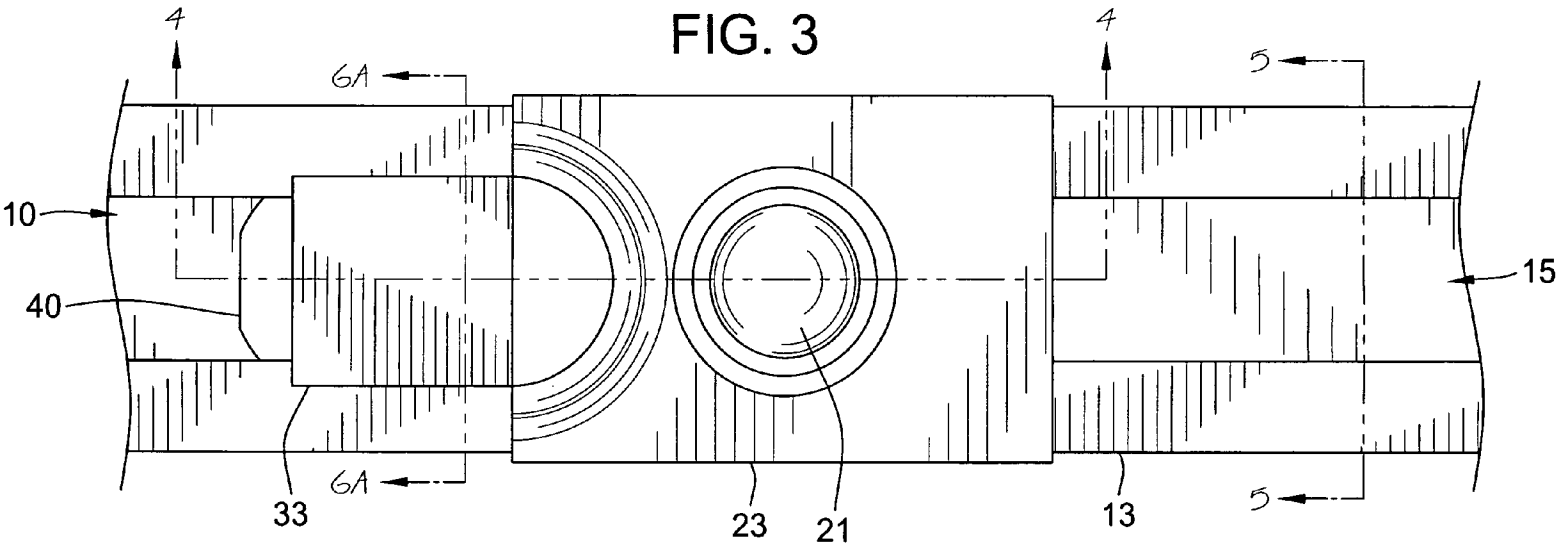
FIG. 3 is an enlarged top plan view of the light module shown in FIG. 1.
Figure 4:
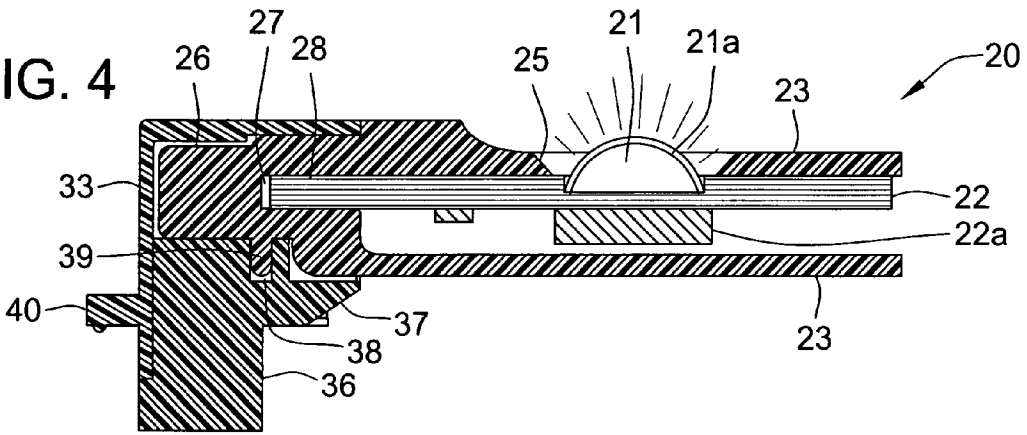
FIG. 4 is a sectional view taken along line 4-4 in FIG. 3.

As can be seen in FIGS. 2 and 4, one end of the sleeve 23 forms a tab 26 for the first housing having a slot 27 for receiving an orthogonal tab 28 on the PCB 22. The portions of the orthogonal tab 28 that project laterally from opposite sides of the slot 27 carry conductors 29 and 30 (see FIG. 2) on both the top and bottom surfaces of the orthogonal tab 28. The orthogonal tab 28 may therefore also be referred to below as the conductor tab 28 to distinguish it from the first housing tab 26. As will be described below, the conductors 29 and 30 serve as the power input terminals for the PCB 22, and are connected to other conductors formed on the PCB 22 to supply power to the LED 21 via conventional circuitry on the PCB 22, including a driver for the LED. A heat sink 22a attached to the PCB 22 directly adjacent the LED 21 dissipates heat via the interior space and open ends of the sleeve 23. PCB's of this type are commercially available, e.g., from Lynk Labs Inc. in Elgin, Ill.

The conductors 29 and 30 on the PCB conductor tab 28 are engaged by a pair of conductive spring contacts 31 and 32 captured inside a non-conductive second housing 33. The spring contacts 31 and 32 (FIG. 2) include integral L-shaped legs 34 and 35 that extend downwardly through an opening in the bottom wall of the second housing 33. When the LED module 20 is attached to the track 10, the lower ends of the legs 34 and 35 make contact with the track conductors 11 and 12. Power can then be supplied from the conductors 11 and 12 through the contacts 31 and 32 to the conductors 29 and 30 on the PCB 22, and then through the circuitry on the PCB to the LED.

The second housing 33 also receives a connector 36 that fits between the two conductive legs 34 and 35 to hold the two spring contacts 31 and 32 in desired positions within the second housing 33. The connector 36 fits into the open lower end of the second housing 33, and is held in place within the second housing 33 by detents formed by mating ribs 36a and grooves 33a formed by opposed surfaces of the connector 36 and the second housing 33 (see FIGS. 6A and 6B). Referring especially to FIG. 4, a cantilevered arm 37 formed by the connector 36 extends along the lower surface of the first housing tab 26, and the top surface of the arm 37 forms a groove 38 that receives a rib 39 depending from the bottom surface of the first housing tab 26. It will be appreciated that the combination of the detents that lock the connector 36 to the second housing 33, and the interlocking groove 38 and rib 39, effectively locks together the second housing 33 and the sleeve, or first housing 23 thereby forming a light module 20 that can be handled as a single unit during installation on the track 10.

Figure 7:
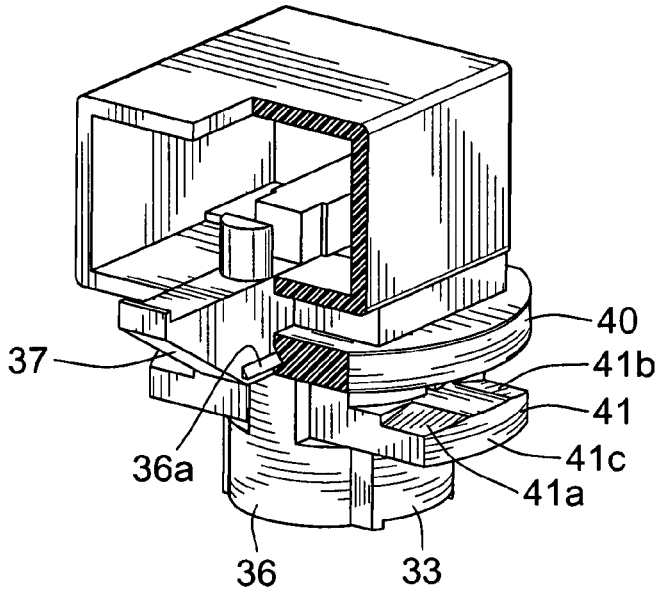
FIG. 7 is an enlarged top perspective of one of the right-hand portion (the second housing of the light module) of the assembly shown in FIG. 1, with a portion cut away to show the internal structure.
Figure 8:
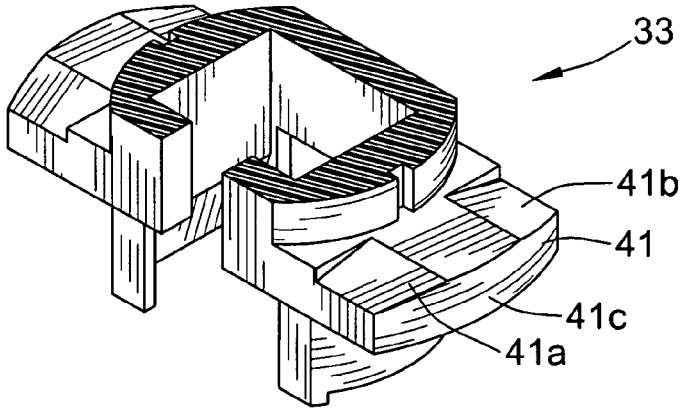
FIG. 8 is an enlargement of the lower portion of the second housing shown in FIG. 7.
Figure 4A:
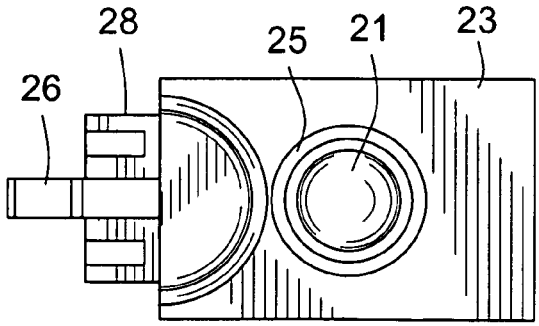
FIG. 4A is a top plan view of the sub-assembly of elements 23 and 28 shown in FIG. 4.
Figure 5:
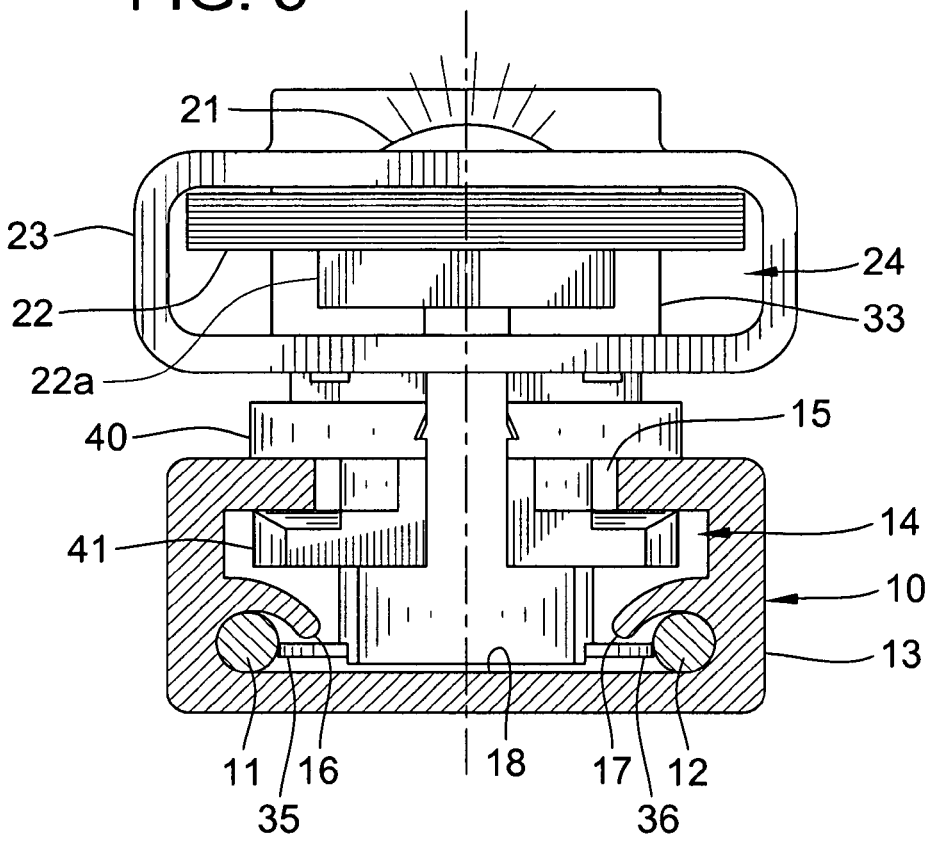
FIG. 5 is a sectional view taken along line 5-5 in FIG. 3.
Figure 6A:
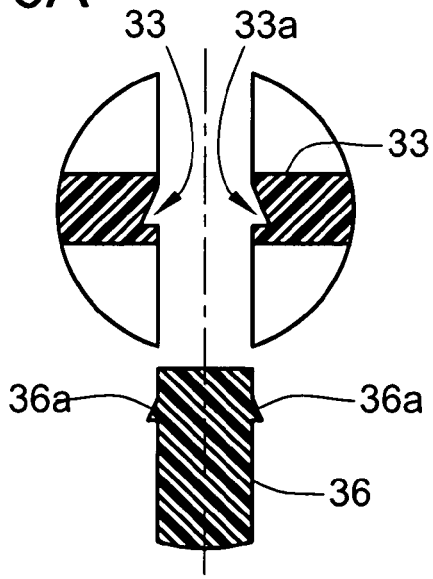
FIG. 6A is a sectional view taken along line 6A-6A in FIG. 3, with the connector detached from the housing.
Figure 6B:
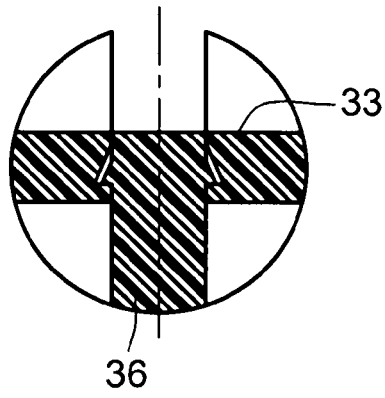
FIG. 6B is the same sectional view shown in FIG. 6A, with the connector attached to the housing.

The lower portion of the second housing 33 forms two pairs of vertically spaced flanges 40 and 41 on opposite sides of the housing (FIGS. 5, 7 and 8). The space between the two flanges 40 and 41 in each pair is dimensioned to receive portions of the top wall of the track housing 13 when the light module 20 is attached to the track 10, as shown in FIG. 5. When the module 20 is rotated 90° (around a vertical axis) from the position shown in FIG. 2, the lower flanges 41 are narrow enough to fit through the longitudinal slot 15 of the track 10, with the lower surfaces of the upper flanges resting on the top surface of the track 10 on opposite sides of the slot 15. Then as the module is rotated to the position shown in FIG. 2 (as well as FIGS. 3-5), the lower flanges 41 slide under the top wall of the track housing 13, thereby fastening the light module 20 to the track 10. Chamfered surfaces 41 a and 41b on the top surfaces of the flanges 41 facilitate smooth sliding engagement of the flanges 41 with the lower surface of the top wall of the track 10 (on both sides of the slot 15) during rotation of the second housing 33 relative to the track 10. Similarly, curved end surfaces 41*c* on the flanges 41 facilitate smooth sliding engagement of the ends of the flanges 41 with the side walls of the track 10 during rotation of the second housing 33 relative to the track 10.

The rotational movement of the module 20 during installation on the track 10 brings the bent lower ends of the legs 34 and 35 of the spring contacts 31 and 32 into firm contact with the track conductors 11 and 12. The free ends of the bent lower ends of the legs 34 and 35 are preferably curved (see FIG. 2) so that they act as cam surfaces as the rotational movement of the module 20 brings those ends of the legs 34 and 35 into engagement with the conductors 11 and 12. As can be seen in FIG. 5, the ends of the legs 34 and 35 engage the respective conductors 11 and 12 slightly below the middle of those conductors, to ensure good electrical contact.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A track light module for use with a low-voltage track carrying a pair of elongated conductors transversely spaced from each other and accessible through a longitudinal slot in the track, said module comprising a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are rotated relative to each other, and said electrical conductors in said second housing are adapted to engage said conductors within said track when said second housing is rotated relative to said track; wherein said surfaces for fastening said second housing to said track comprise two pairs of spaced flanges, one flange in each pair being narrow enough to fit into said longitudinal slot in said track, said flanges having opposed surfaces that slide across the top and bottom surfaces of the top wall of said track when said second housing is rotated within said slot, with the ends of said flanges sliding across the bottom surface of said to wall engaging the inside surfaces of the side walls of said track.

2. The track light module of claim 1 in which said printed circuit board includes a heat sink mounted on the opposite side of said printed circuit board from said LED, and said first housing forms a space around said heat sink for dissipating heat from said heat sink.

3. The track light module of claim 1 which includes a lens covering said LED, the interior surface of said lens having a phosphor coating to diffuse light emitted by said LED and to provide a desired color temperature of light.

4. The track light module of claim 1 in which said connector and said first housing include interlocking surfaces that lock them together, and said connector and said second housing include interlocking surfaces that lock them together.

5. The track light module of claim 1 in which said printed circuit board forms a tab projecting from one end and carrying said electrical contacts, said first housing forms a tab projecting from one into said second housing and forming a slot for receiving said tab of said printed circuit board, said tab of said printed circuit board projecting laterally from opposite sides of said tab of said first housing to permit contact between said electrical contacts and said electrical conductors in said second housing.

6. The track light module of claim 5 in which said connector and said tab of said first housing include interlocking surfaces that lock them together, and said connector and said second housing include interlocking surfaces that lock them together.

7. A track lighting assembly comprising a low-voltage track carrying a pair of elongated conductors transversely spaced from each other and accessible through a longitudinal slot in the track, and a light module including a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are rotated relative to each other, and said electrical conductors in said second housing are adapted to engage said conductors within said track when said second housing is rotated relative to said track, a pair of electrical contacts on said printed circuit board for contacting said conductors carried by said second housing and thereby receiving electrical power for said LED, and a connector for attaching said first and second housings together.

8. The track light module of claim 7 in which said surfaces for fastening said second housing to said track comprise two pairs of spaced flanges, one flange in each pair being narrow enough to fit into said longitudinal slot in said track, said flanges having opposed surfaces that slide across the top and bottom surfaces of the top wall of said track when said second housing is rotated within said slot, with the ends of said flanges sliding across the bottom surface of said to wall engaging the inside surfaces of the side walls of said track.

9. The track light module of claim 7 in which said printed circuit board includes a heat sink mounted on the opposite side of said board from said LED, and said first housing forms a space around said heat sink for dissipating heat from said heat sink.

10. The track light module of claim 9 which includes a lens covering said LED, the interior surface of said lens having a phosphor coating to diffuse light emitted by said LED and to provide a desired color temperature of light.

11. The track light module of claim 7 in which said connector and said first housing include interlocking surfaces that lock them together, and said connector and said second housing include interlocking surfaces that lock them together.

12. The track light module of claim 7 in which said printed circuit board forms a tab projecting from one end and carrying said electrical contacts, said first housing forms a tab projecting from one into said second housing and forming a slot for receiving said tab of said printed circuit board, said tab of said printed circuit board projecting laterally from opposite sides of said tab of said first housing to permit contact between said electrical contacts and said electrical conductors in said second housing.

13. The track light module of claim 12 in which said connector and said tab of said first housing include interlocking surfaces that lock them together, and said connector and said second housing include interlocking surfaces that lock them together.

14. A track light module for use with a low-voltage track carrying a pair of elongated conductors transversely spaced from each other and accessible through a longitudinal slot in the track, said module comprising a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are moved relative to each other, said surfaces for fastening said second housing to said track comprising two pairs of spaced flanges, one flange in each pair being narrow enough to fit into said longitudinal slot in said track, said flanges having opposed surfaces that slide across the top and bottom surfaces of the top wall of said track when said second housing is rotated within said slot, with the ends of said flanges sliding across the bottom surface of said to wall engaging the inside surfaces of the side walls of said track, a pair of electrical contacts on said printed circuit board for contacting said conductors carried by said second housing and thereby receiving electrical power for said LED, and a connector for attaching said first and second housings together.

15. A track light module for use with a low-voltage track carrying a pair of elongated conductors transversely spaced from each other and accessible through a longitudinal slot in the track, said module comprising a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are moved relative to each other, a pair of electrical contacts on said printed circuit board for contacting said conductors carried by said second housing and thereby receiving electrical power for said LED, said printed circuit board forms a tab projecting from one end and carrying said electrical contacts, said first housing forms a tab projecting from one into said second housing and forming a slot for receiving said tab of said printed circuit board, said tab of said printed circuit board projecting laterally from opposite sides of said tab of said first housing to permit contact between said electrical contacts and said electrical conductors in said second housing, and a connector for attaching said first and second housings together.

16. A track lighting assembly comprising a low-voltage track carrying a pair of elongated conductors transversely spaced from each other and accessible through a longitudinal slot in the track, and a light module including a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are moved relative to each other, said surfaces for fastening said second housing to said track comprising two pairs of spaced flanges, one flange in each pair being narrow enough to fit into said longitudinal slot in said track, said flanges having opposed surfaces that slide across the top and bottom surfaces of the top wall of said track when said second housing is rotated within said slot, with the ends of said flanges sliding across the bottom surface of said to wall engaging the inside surfaces of the side walls of said track.

a pair of electrical contacts on said printed circuit board for contacting said conductors carried by said second housing and thereby receiving electrical power for said LED, and a connector for attaching said first and second housings together.

17. A track lighting assembly comprising a low-voltage track carrying a pair of elongated conductors transversely spaced from each other and accessible through a longitudinal slot in the track, and a light module including a first housing containing a printed circuit board carrying an LED, said first housing forming an aperture permitting light from said LED to be radiated beyond said first housing, a second housing carrying a pair of electrical conductors adapted to extend into the low-voltage track to make contact with said conductors within said track, said second housing also including surfaces for fastening said second housing to said track when said second housing and said track are moved relative to each other, a pair of electrical contacts on said printed circuit board for contacting said conductors carried by said second housing and thereby receiving electrical power for said LED, said printed circuit board forms a tab projecting from one end and carrying said electrical contacts, said first housing forms a tab projecting from one into said second housing and forming a slot for receiving said tab of said printed circuit board, said tab of said printed circuit board projecting laterally from opposite sides of said tab of said first housing to permit contact between said electrical contacts and said electrical conductors in said second housing, and a connector for attaching said first and second housings together.

* * * * *